US005552877A

United States Patent [19]

Ishikawa et al.

[11] Patent Number: 5,552,877

[45] Date of Patent: Sep. 3, 1996

[54] IMAGE FORMING APPARATUS WITH CONTROLLED DRIVE FOR ACCURATELY POSITIONING DEVELOPING SECTIONS OF A ROTARY DEVELOPING DEVICE

[75] Inventors: Tomoji Ishikawa; Kazuyuki Sugihara, both of Yokohama; Katsuhiro Kosuge, Tokyo, all of Japan

[73] Assignee: Ricoh Company, Ltd., Tokyo, Japan

[21] Appl. No.: 424,046

[22] Filed: Apr. 19, 1995

[30] Foreign Application Priority Data

Apr. 20, 1994 [JP] Japan ..... 6-106021
Mar. 21, 1995 [JP] Japan ..... 7-088885

[51] Int. Cl.[6] ..... G03G 15/01
[52] U.S. Cl. ..... 355/326 R; 355/327
[58] Field of Search ..... 355/326 R, 327

[56] References Cited

U.S. PATENT DOCUMENTS 4,593,991 6/1986 Aoki et al. ..... 355/327
5,168,319 12/1992 Kimura et al. ..... 355/326 R

FOREIGN PATENT DOCUMENTS 3-249780 11/1991 Japan .
5-241418 9/1993 Japan .

*Primary Examiner*—Nestor R. Ramirez
*Attorney, Agent, or Firm*—Oblon, Spivak, McClelland, Maier & Neustadt, P.C.

[57] ABSTRACT

An image forming apparatus having a rotary developing device or revolver in which a plurality of developing sections are defined. The revolver is rotated over a target position by a first drive source, then returned by a second drive source producing a moment acting in the opposite direction, such as due to the drive of one of the developing sections, and then positively stopped by a positioning mechanism. The revolver is, therefore, accurately positioned at the target position without regard to, for example, irregularities in a motor for driving the revolver.

9 Claims, 16 Drawing Sheets

IMAGE FORMING APPARATUS WITH CONTROLLED DRIVE FOR ACCURATELY POSITIONING DEVELOPING SECTIONS OF A ROTARY DEVELOPING DEVICE

BACKGROUND OF THE INVENTION

The present invention relates to an image forming apparatus using a rotary developing unit having a plurality of developing sections therein and, more particularly, to an image forming apparatus capable of accurately positioning the developing sections, or movable bodies, as to the rotation angle.

A copier, facsimile apparatus, printer or similar image forming apparatus includes a photoconductive element, or image carrier, and a developing device facing the element. The developing device is often implemented as a rotary developing device, or revolver as generally referred to, having a plurality of developing sections therein. The developing sections each stores a toner of particular color. The revolver is rotated to bring one of the developing sections to a developing position where it faces the photoconductive element. At the developing position, the developing section develops a latent image formed on the photoconductive element by the toner thereof. This kind of developing device is disclosed in, for example, Japanese Patent Laid-Open Publication Nos. 62-251772 and 63-78170 and Japanese Utility Model Laid-Open Publication No. 63-41164. The prerequisite with the revolver is that the developing sections be sequentially brought to and accurately positioned at the developing position. For this purpose, it has been proposed to form recesses, each matching the respective developing section, in the outer periphery of the rear end wall or similar wall of the revolver, and to mount a roller capable of falling in one of the recesses at a time on a predetermined position of the apparatus body. The revolver is rotated by an amount necessary for one of the recesses matching the developing section to be used to face the roller. As a result, the roller falls in the recess and thereby accurately positions the revolver.

However, with the revolver of the type described, it is likely that the necessary amount of rotation cannot be achieved due to irregularities in a motor assigned to the revolver and changes in load. As a result, the roller fails to mate with the expected recess, i.e., to accurately position the revolver. It follows that the distance between a developing roller disposed in the developing section brought to the developing position and the photoconductive element differs from a target distance, resulting in poor image quality. This is also true with other various movable bodies arranged in the image forming apparatus and needing accurate positioning.

SUMMARY OF THE INVENTION

It is, therefore, an object of the present invention to provide an image forming apparatus capable of accurately positioning each of a plurality of developing sections of a revolver included therein at a developing position.

In accordance with the present invention, an image forming apparatus has a first movable body movably mounted on the body of the apparatus, a second movable body movably mounted on the first movable body, a first drive source for driving the first movable body, a second drive source for exerting, when a predetermined drive input is applied to the second movable body, a moving force on the first movable body in a direction opposite to a predetermined direction in which the first movable body is moved by the first drive source, a positioning device incapable of positioning the first movable body in contact therewith against a moving force acting in the predetermined direction, or capable of positioning it in contact therewith against a moving direction acting in the direction opposite to the predetermined direction, and a controller for controlling the first drive source such that the first movable body moves in the predetermined direction over a target position.

Further, in accordance with the present invention, an image forming apparatus for causing a rotary developing device rotatably mounted on the body of the apparatus and having a plurality of developing sections therein to rotate to thereby move any one of the developing sections to a developing position has a first drive source for rotating the developing device in a predetermined direction over a target position, a second drive source for rotating the developing device rotated over the target position in a direction opposite to the predetermined direction to thereby return it toward the target position, and a positioning device for causing the developing device arrived at the target position to stop there.

Furthermore, in accordance with the present invention, a method of positioning a rotary developing device as to the rotation angle, and for an image forming apparatus for causing the developing device rotatably mounted on the body of the apparatus and having a plurality of developing sections therein to rotate to thereby move any one of the developing sections to a developing position has the steps of rotating the developing device in a predetermined direction over a target position, switching a driving direction to thereby return the developing device toward the target position, and positioning the developing device at the target position by exerting a stopping force on the developing device.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
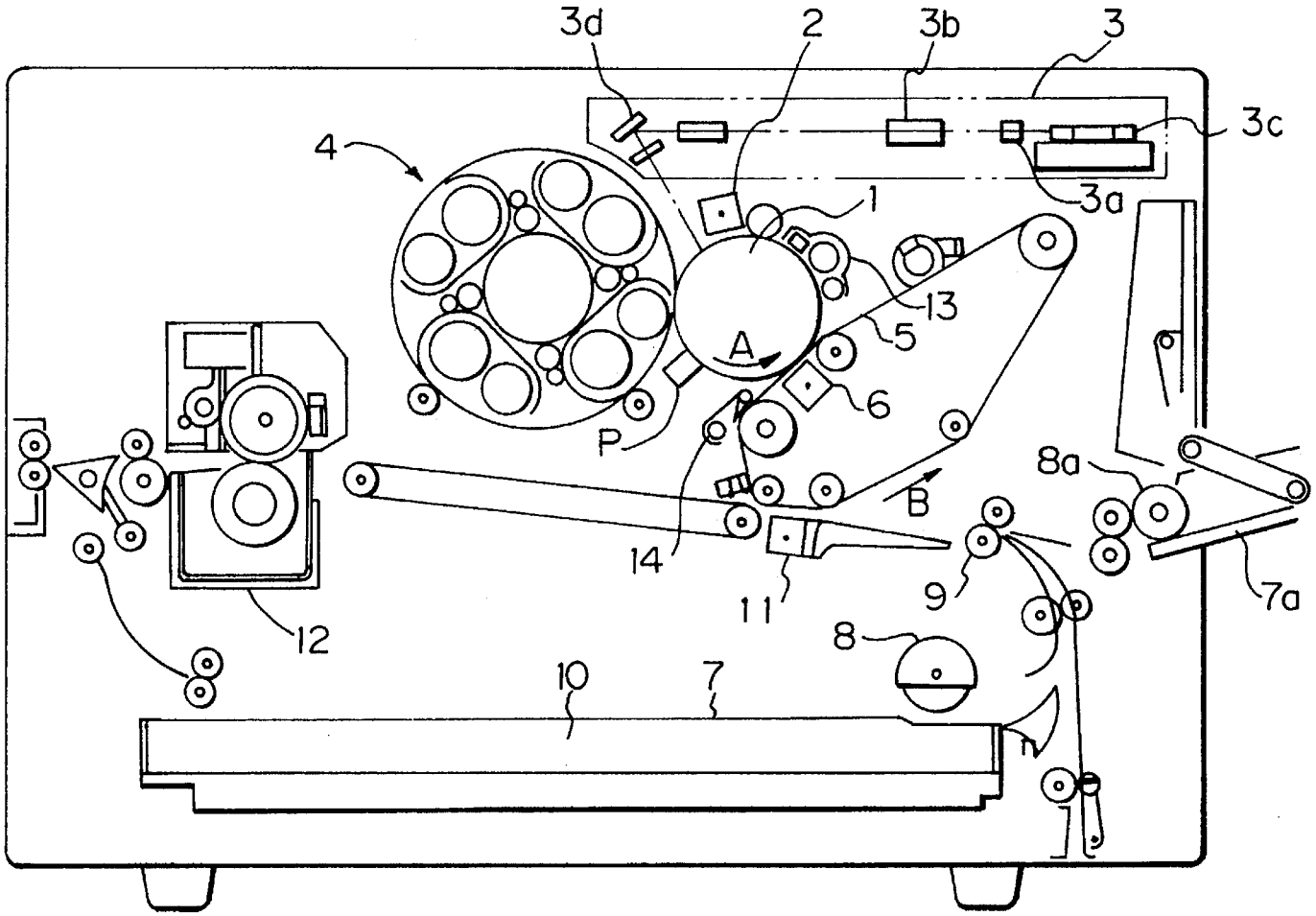
FIG. 1 is a section of an image forming apparatus embodying the present invention and implemented as an electrophotographic printer.

Referring to FIG. 1 of the drawings, an image forming apparatus embodying the present invention is shown and implemented as a electrophotographic color printer. As shown, the printer has a photoconductive drum, or image carrier, 1 which is rotated in a direction indicated by an arrow in the figure. A main charger 2 uniformly charges the surface of the drum 1. Laser optics 3 scans the charged surfaces of the drum 1 in accordance with image data and thereby electrostatically forms a latent image thereon. The image data consist of yellow data, magenta data, cyan data and black data generated by separating a desired full-color image. Latent images sequentially formed on the drum 1 are each developed by one of yellow toner, magenta toner, cyan toner and black toner stored in a rotary developing device or revolver 4 which will be described. As a result, the latent images are transformed to toner images of respective colors.

An intermediate transfer belt 5 is rotated in synchronism with the drum 1 in a direction B. The toner images formed on the drum 1 are sequentially transferred to the belt 5 by a primary transfer charger 6 one above the other, thereby forming a composite color image. A paper 10 is fed from a duplex copy/automatic paper teed casette 7 or a manual paper feed tray 7*a* to an image transfer position by a pick-up roller 8 or 8*a* and a registration roller pair 9. A secondary transfer charger 11, located at the image transfer position, transfers the composite color image from the belt 5 to the paper 10. A fixing unit 12 fixes the color image on the paper 10. The paper 10 with the color image is driven out of the printer as a full-color printing. A drum cleaner 3 removes the toner remaining on the drum 1 after the image transfer. Likewise, a belt cleaner 14 removes the toner remaining on the belt 5 after the image transfer.

Figure 2:
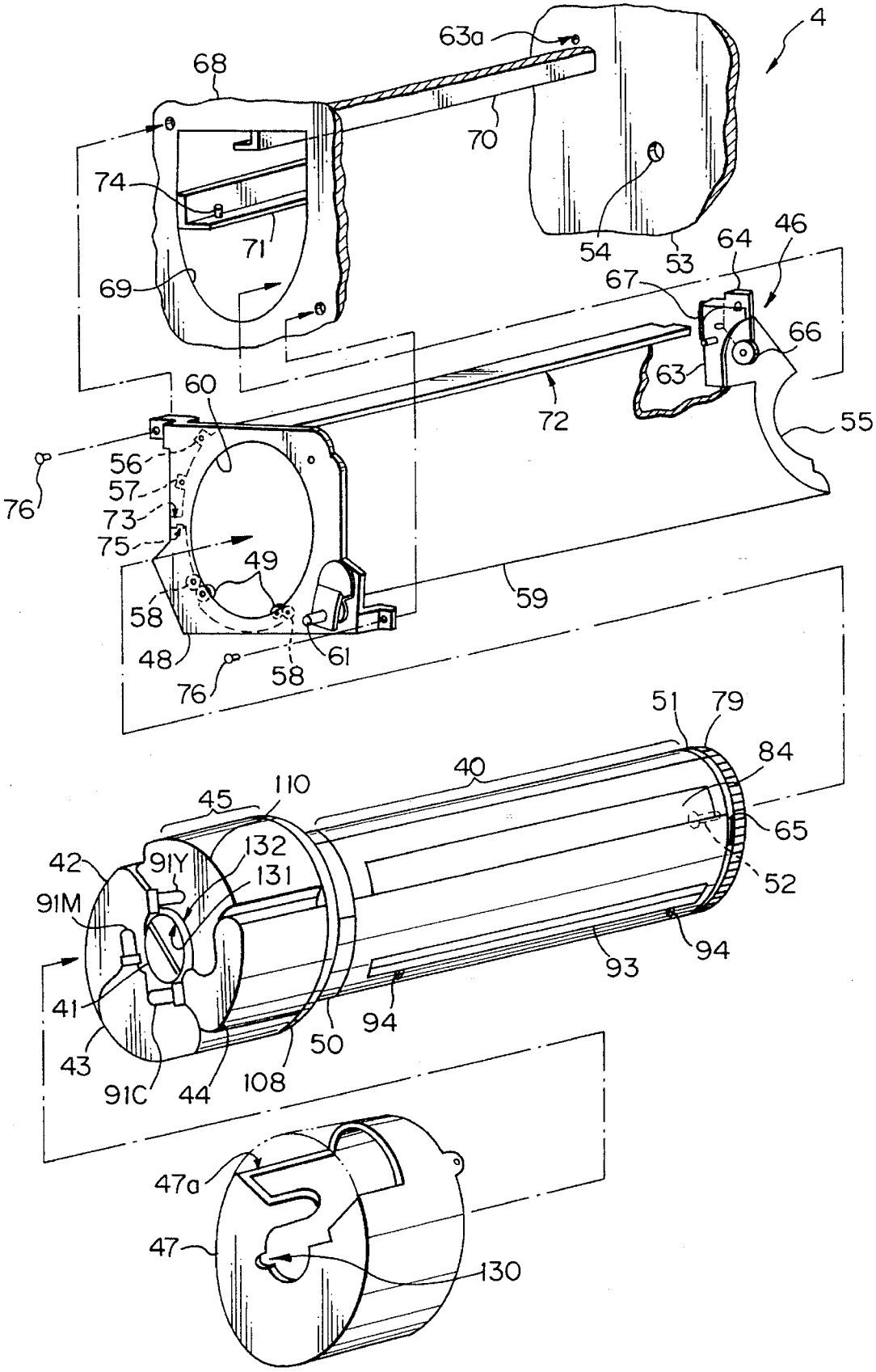
FIG. 2 is an exploded external perspective view of a revolver included in the printer.

As shown in FIG. 2, the revolver 4 has a substantially cylindrical developing unit 40 and a toner storing unit 45. The developing unit 40 is rotatable about its own axis and has four developing sections therein which are assigned to, for example, black, cyan, yellow, and magenta, respectively. The toner storing unit 45 is coaxial with and located at the front of the developing unit 40. Four toner containers 41, 42, 43 and 44 are removably mounted to the storing unit 45 and held in one-to-one correspondence with the four developing sections of the developing unit 40. The toner containers 41–44 store black toner, yellow toner, magenta toner, and cyan toner, respectively. The storing unit 45 is rotatable integrally with the developing unit 40. A casing 46 supports the developing unit and storing unit 45, i.e., the revolver and is slidable relative to the printer body substantially in parallel to the axis of the revolver. A cover 47, which is not rotatable, covers the storing unit 45.

Two support rollers 49, for example, are mounted on the front support wall 48 of the casing 46. The developing unit 40 has a front wall 50 and a rear wall 51 each having a disk-like configuration. The front wall 50 is supported by the support rollers 49. A tapered center shaft 52 extends out from the center of the rear wall 51 and rotatably received in a hole 54 formed in a rear panel 53 forming part of the printer body. In this condition, the revolver is rotatable in the printer body and positioned such that the axis thereof is parallel to the axis of the drum 1 substantially in the same plane, as shown in FIG. 1.

Figure 7A:
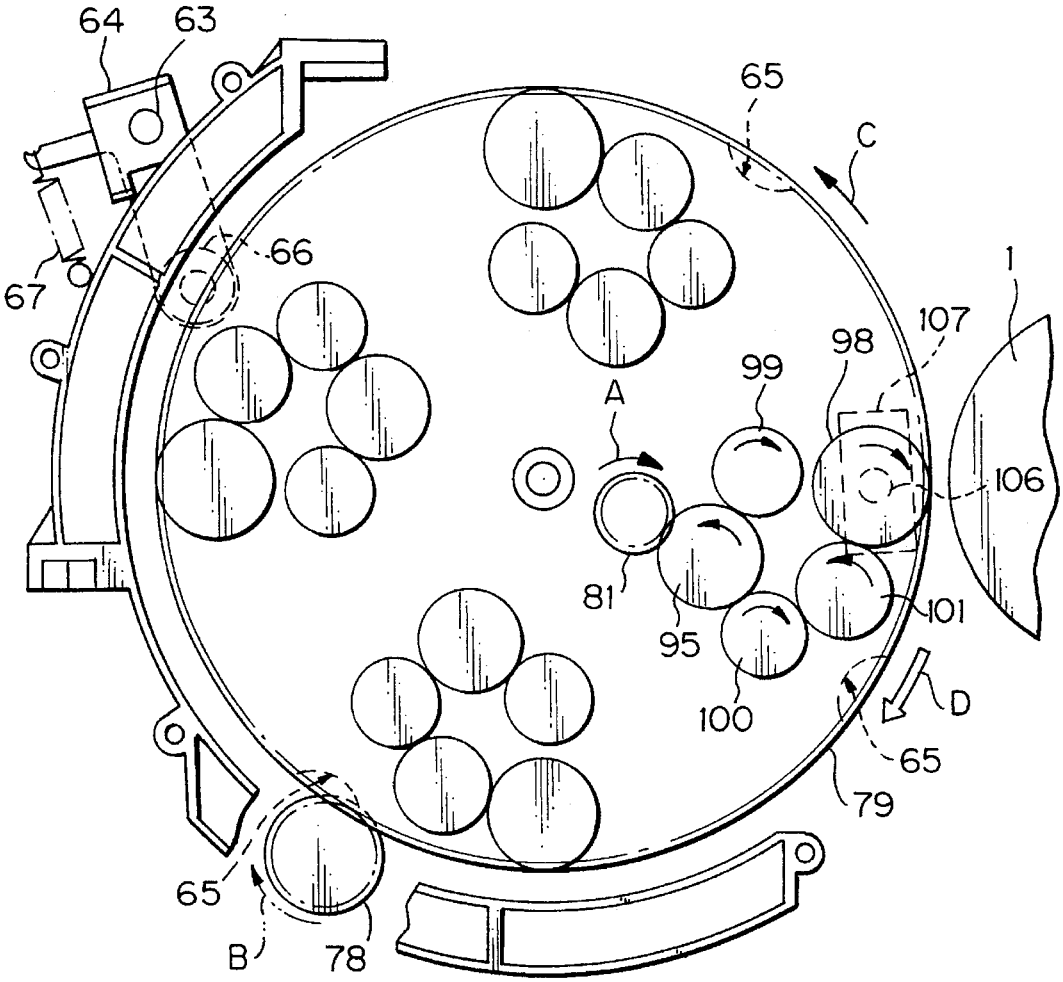
FIG. 7A is a perspective front view of a drive system for driving the revolver.
Figure 7B:
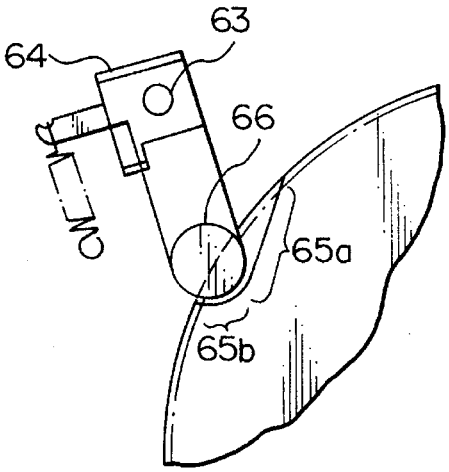
FIG. 7B shows an arrangement for applying a bias to the developing section.

The casing 46 has, in addition to the front support wall 48, a rear support wall 55 and a side cover 59. The side cover 59 is affixed to the support walls 48 and 55 at opposite ends thereof and reinforced by tie bars 56, 57 and 58. An opening 60 is formed through the front support wall 48 for receiving the revolver. A motor 61 and a gear train 62 (see FIG. 3) are also mounted on the support wall 48. The motor 61 drives via the gear train 62 toner supply rollers which are disposed in the toner storing unit 45. As shown in FIG. 4, an intermediate plate 63 is disposed in the casing 46 and supported by the tie bars 56 and 57 in the vicinity of the rear support wall 55. A positioning pin 63*b* is studded on the plate 63 and received in a positioning hole 63*a* formed in the rear panel 53. A bracket 64 is rotatably mounted at one end thereof on the part of the pin 63*b* intervening between the plate 63 and the rear support wall 55. A positioning roller 66 is mounted on the other end of the bracket 64. The roller 66 falls in any one of a plurality of (four in the embodiment) recesses 65 formed on the outer periphery of the rear end wall of the developing unit 40. A spring 67 constantly biases the bracket 64 in a direction indicated by an arrow. As a result, when one of the recesses 65 faces the roller 66, the roller 66 is surely caused to fall in the recess 65, as shown in FIGS. 7A and 7B specifically. How the revolver is positioned by use of the recesses 65, roller 66 and other constituents will be described in detail later.

A front panel 68 included in the printer body is formed with an opening 69 for receiving the casing 46 carrying the revolver therewith. An upper guide 70 and a lower guide 71 extend between the front panel 53 and the rear panel 68 of the printer body. The casing 46 is slidably supported by the guides 70 and 71. Specifically, the side cover 59 of the casing 46 has portions 72 and 73 to be guided by the guides 70 and 71 at the top and the side, respectively. A channel 73 is formed in the bottom of the portion 73 and receives an upright guide pin 74 studded on the guide 71. When the casing 46 is moved into and out of the printer body, the channel 75 causes it to move away from the drum 1. Also, when the casing 46 is fully set on the printer body, the channel 75 guides the revolver to a predetermined position relatively close to the drum 1. For this purpose, the channel 75 is bent such that a predetermined front portion thereof is closer to the drum 1 than a rear portion.

The positioning pin 63*b*, studded on the intermediate plate 63, has a tapered tip. The tapered tip begins to enter the hole 63*a* of the rear panel 53 immediately before the casing 46 is fully received in the printer body, and accurately positions the rear support wall 55 of the casing 46 when the casing 46 is fully received. The front support wall 48 of the casing 46 is affixed to the printer front panel 68 by, for example, screws 76 after the casing 46 has been inserted in the printer body. The screws 76 may be replaced with a tapered positioning pin, if desired. When the casing 46 is not inserted in the printer body, the rear end of the revolver is supported by the rear support wall 55 of the casing 46. However, immediately before the casing 46 is fully received in the printer body, the tapered center shaft 52 begins to enter the hole 54 of the printer rear panel 53, sequentially lifting the revolver. When the casing 46 is fully inserted into the printer body, the revolver is fully raised away from the support wall 55. In this condition, the front end of the revolver is supported by the rollers 49 of the front support wall 48 which has been accurately positioned on the printer body. At the same time, the rear end of the revolver is rotatably positioned relative to the printer rear panel 53.

Figure 3:
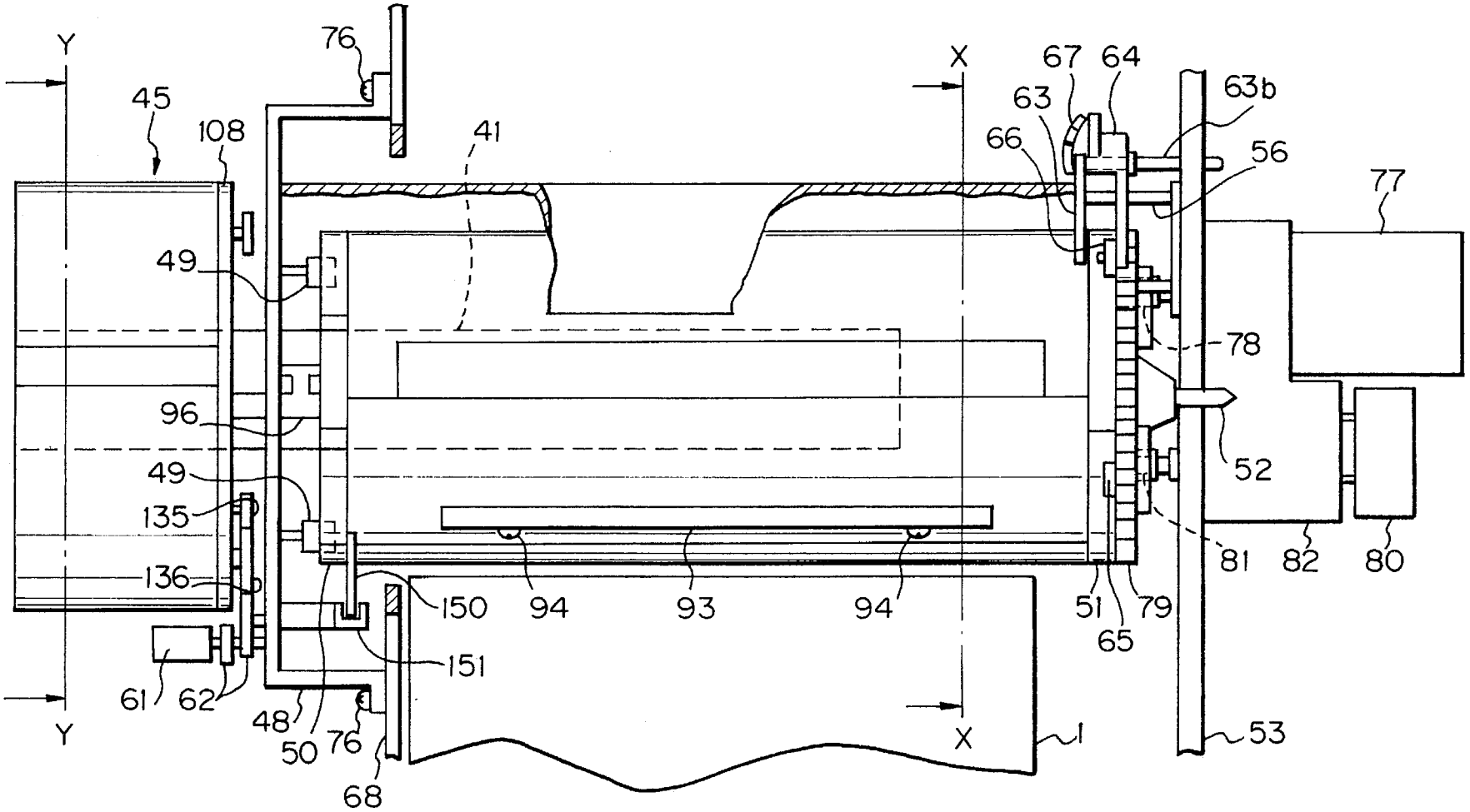
FIG. 3 is a plan view of the revolver.
Figure 4:
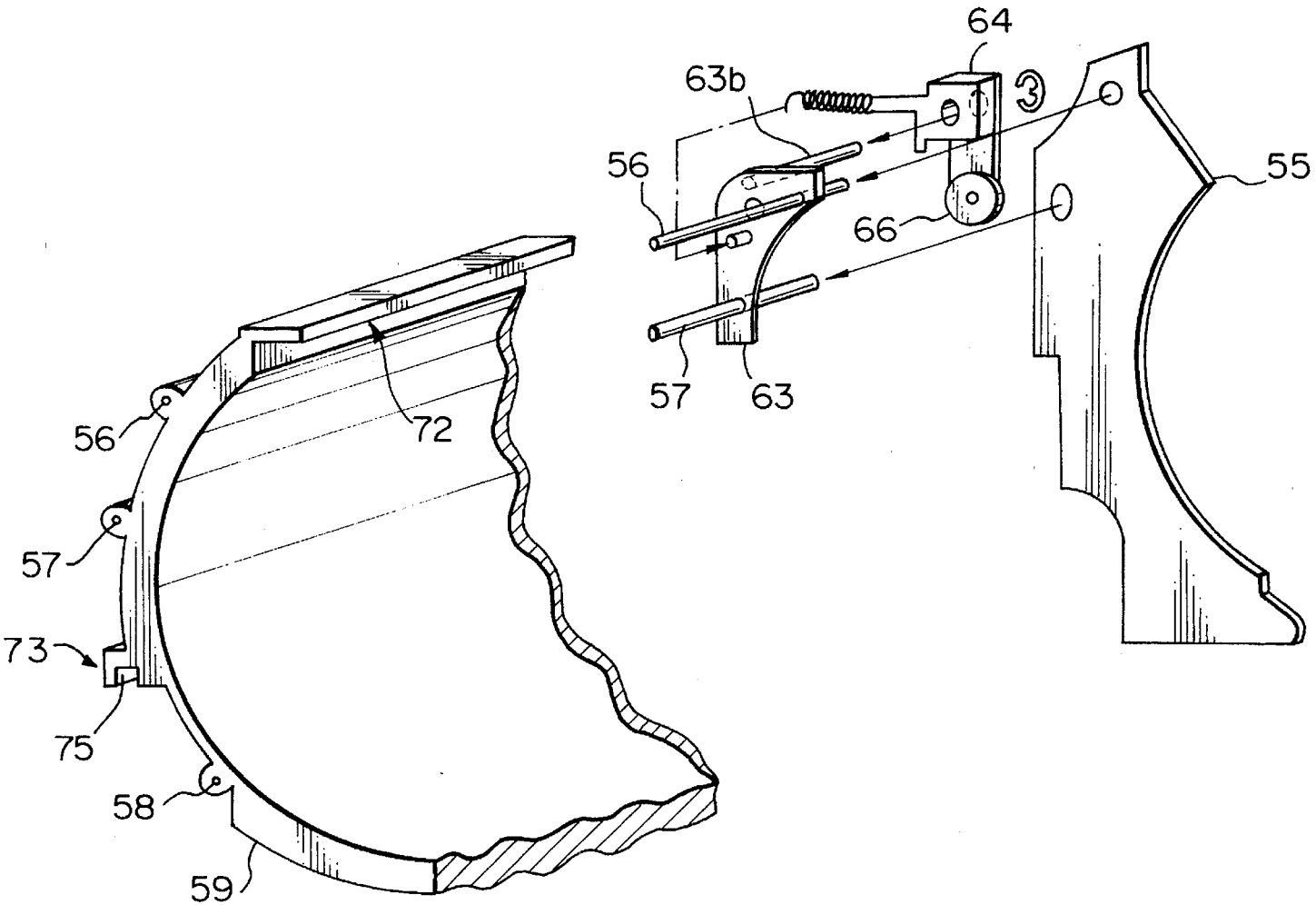
FIG. 4 is a fragmentary enlarged perspective view of the revolver.

As shown in FIG. 3, a motor 77 for driving the revolver is mounted on the printer rear panel 53 and implemented as a stepping motor by way of example. An output gear 78 is also mounted on the printer rear panel 53 and driven by the motor 77. The output gear 78 is held in mesh with an input gear 79 having substantially the same diameter as the output gear 78. The input gear 79 is fastened to the rear of the rear end wall of the developing unit 40. Also mounted on the printer rear panel 53 are a motor 80 for driving developing rollers and other rotary bodies built in the developing unit 40, an output gear 81 to be driven by the motor 80, a gear box 82 accommodating a gear train 62 connecting the motors to the respective output gears.

Figure 5:
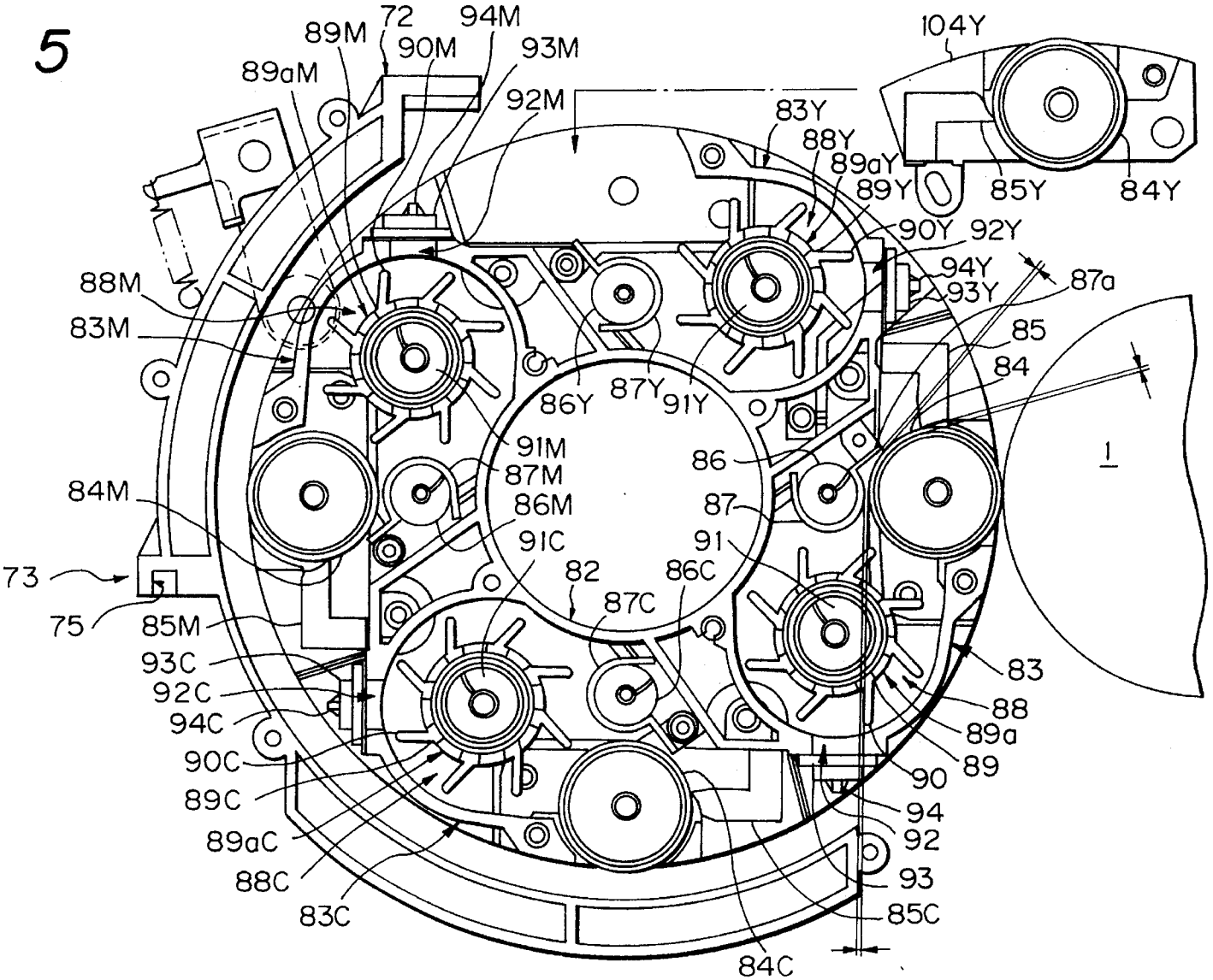
FIG. 5 is a section along line X—X of FIG. 3.

FIG. 5 is a section along line X—X of FIG. 3 and showing the internal arrangement of the developing unit 40. As shown, the developing unit 40 has, in addition to disk-like front and end walls (see FIG. 3), partition walls intervening between the front and rear walls. The partition walls consist of a hollow cylindrical portion 82 for receiving a cylindrical black toner bottle, and four casing portions 83, 83C, 83M and 83Y. The casing portions 83–83Y extend radially from the cylindrical portion 82 and partition the space around it into four developing chambers having substantially an identical shape. The chambers each stores a mixture of carrier and toner of particular color, i.e., a two-component type developer. In the condition shown in FIG. 5, the chamber storing the black toner and carrier is shown as facing the drum 1 at the developing position. The chambers storing the yellow toner and carrier, magenta toner and carrier, and cyan toner and carrier, respectively, are sequentially arranged in this order in the clockwise direction, as viewed in the figure.

The following description will concentrate on the black developing chamber located at the developing position. The other developing chambers are distinguished from the black developing chamber and from each other by suffixes Y, M and C.

In the black developing chamber, the casing part 83 is formed with an opening facing the drum 1. A developing roller 84 is positioned in the chamber and partly exposed to the outside through the opening. Also disposed in the chamber are a doctor blade 85, an upper screw 86, a guide 87 for the screw 86, and a paddle 88. The doctor blade 85 regulates the amount of toner to be conveyed by the roller 84 to the developing position. The upper screw 86 conveys part of the developer removed by the doctor blade 85 from the rear to the front along the axis thereof. Specifically, the paddle 88 has a hollow cylindrical portion 89 formed with a plurality of developer outlets **89*a* extending in the axial direction of the roller 84, and a plurality of blades 90 extending radially from the portion 89. A lower screw 91 is disposed in the portion 89 and conveys the developer along the axis thereof in the opposite direction to the screw 86. The casing portion is formed with an outlet 92 below the lower screw 91. The outlet 92 extends in the axial direction of the revolver and is selectively used to discharge a deteriorated developer or to replenish a fresh developer (with toner). A cap 93 is fitted oil the casing portion by, for example, a screw 94 in order to close the outlet 92**.

To promote efficient discharge of the deteriorated developer from the outlet 92, it is preferable to pull out the revolver from the printer body together with the casing 46, rotate an input gear 95 (see FIG. 7A), as well as others, by use of a jig, and then discharge the developer while rotating the developing roller 84, screws 86 and 91, and paddle 88. Also, to introduce a fresh developer via the outlet 92, the roller 84, screws 86 and 91 and paddle should preferably be rotated in order to evenly scatter the developer.

Figure 6:
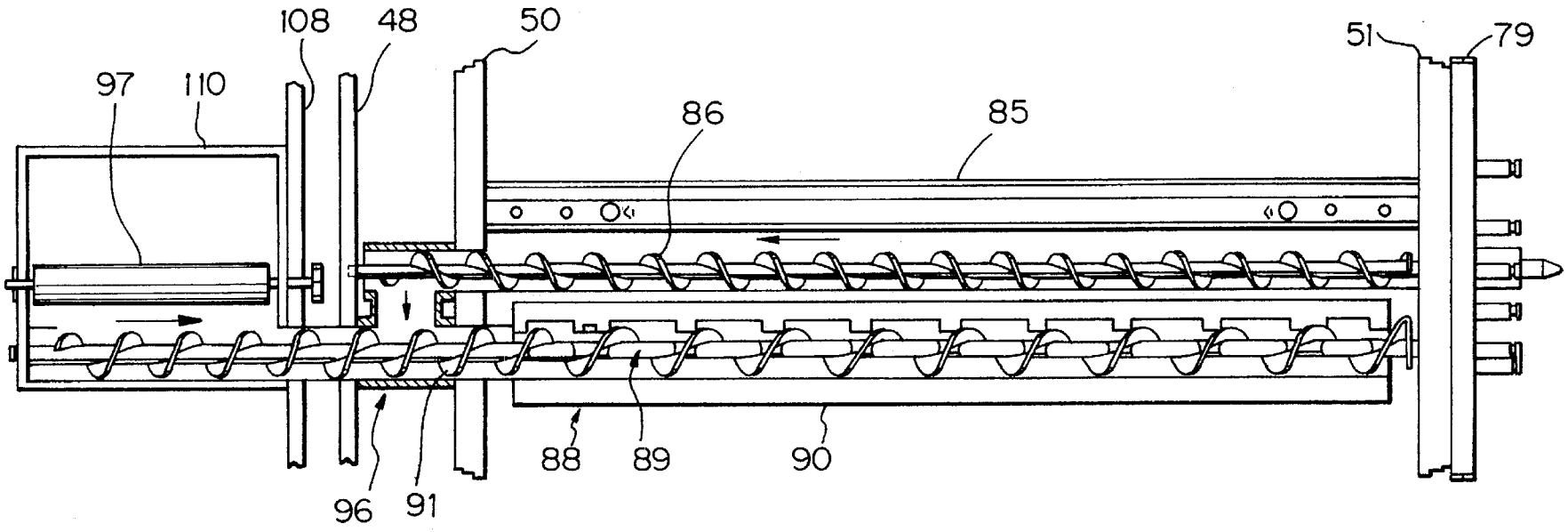
FIG. 6 is a section showing the connection of a developing section and a toner containing section.

FIG. 6 is a vertical section in a plane containing the axes of the upper and lower screws 86 and 91. As shown, the front ends of the screws 86 and 91 are extended to the outside of the effective width of the developing roller 84 (to the outside of the end wall 50 of the developing unit 40 in the illustrative embodiment). A drop section 96 is formed around the extensions of the screws 86 and 91. In the drop section 96, the developer conveyed by the screw 86 is dropped onto the screw 91 by gravity. The front end of the screw 91 is further extended beyond the drop section 96 to a communication chamber below a toner supply roller 97 which is included in the toner storing unit 45, as will be described specifically later. In this configuration, the developer deposited on the roller 84 is partly removed by the doctor blade 85 and then conveyed to the front by the guide 87 and screw 86. At the drop section 96, this part of the developer is dropped onto the screw 91. The screw 91 conveys the developer into the effective width of the roller 84. As a result, the developer is discharged from the paddle 88 into the chamber via the outlet **89*a* and again deposited on the roller 84. In this manner, the developer is agitated in the chamber in the horizontal direction. The developer discharged to the lower portion of the chamber via the outlets 89*a* is agitated by the blades 90 of the paddle 88 in the vertical direction. At the same time, the toner supply roller 97 is rotated to drop a fresh toner onto the screw 91 in the communication chamber. The screw 91 conveys the fresh toner to the drop section 96. On reaching the drop section 96, the toner is mixed with the developer dropped from the screw 86. The resulting mixture enters the chamber via the outlets 89*a***, thereby increasing the toner concentration in the chamber.

FIG. 7A is a perspective view of the rear end wall 51 of the developing unit 40. As shown, various gears are mounted on the wall 51 at the rear of the revolver input gear 79. The shaft of the developing roller 84 extends throughout the wall 51 to the rear or the input gear 79. A gear 98 is mounted on the protruding end of the shaft of the roller 84. Likewise, the shafts of the screws 86 and 91 extend throughout the wall 51 to the rear of the input gear 79. Gears 99 and 100 are mounted on the protruding ends or the screws 86 and 91, respectively. An idle gear 101 is mounted on the rear of the wall 51 and held in mesh with the gears 98 and 100. An input gear 95 is also mounted on the rear of the wall 51 and engageable with the output gear 81. The revolver, carrying such gears on the wall 51 thereof, is received in the casing 46 and then inserted into the printer body, as stated earlier. As a result, the input gear 95 of the revolver is brought into mesh with the output gear 81 or the printer body, as shown in FIG. 7A. At the same time, the input gear 79 of the revolver meshes with the output gear 78 of the printer body.

Figure 8A:
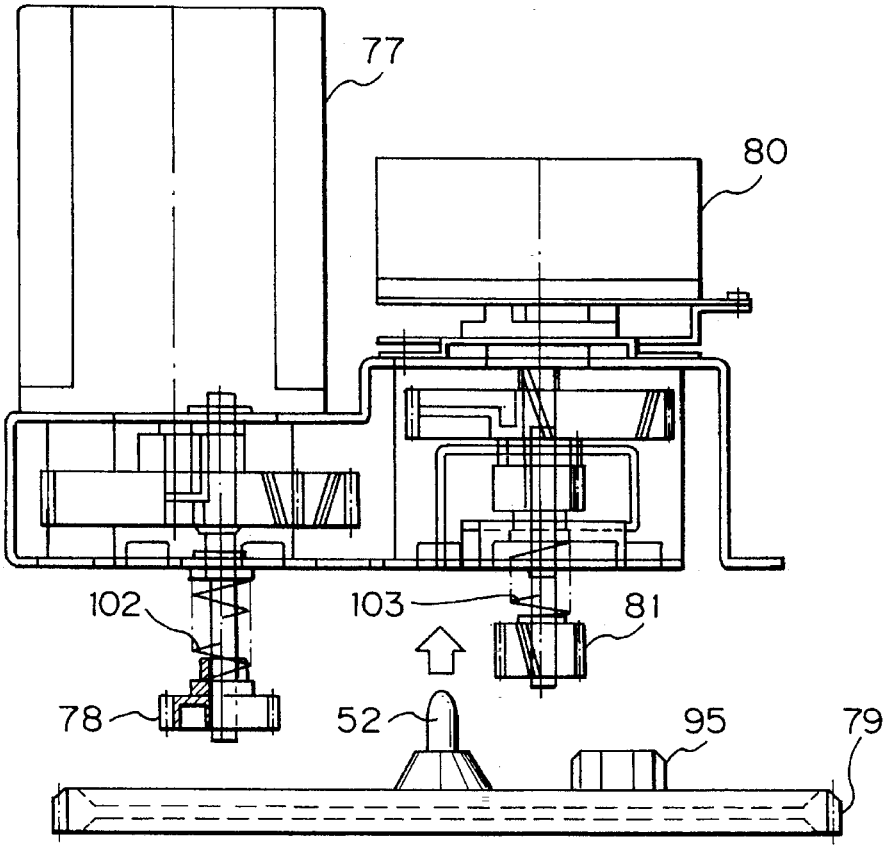
FIG. 8A is a plan view of a motor for driving the revolver.
Figure 8B:
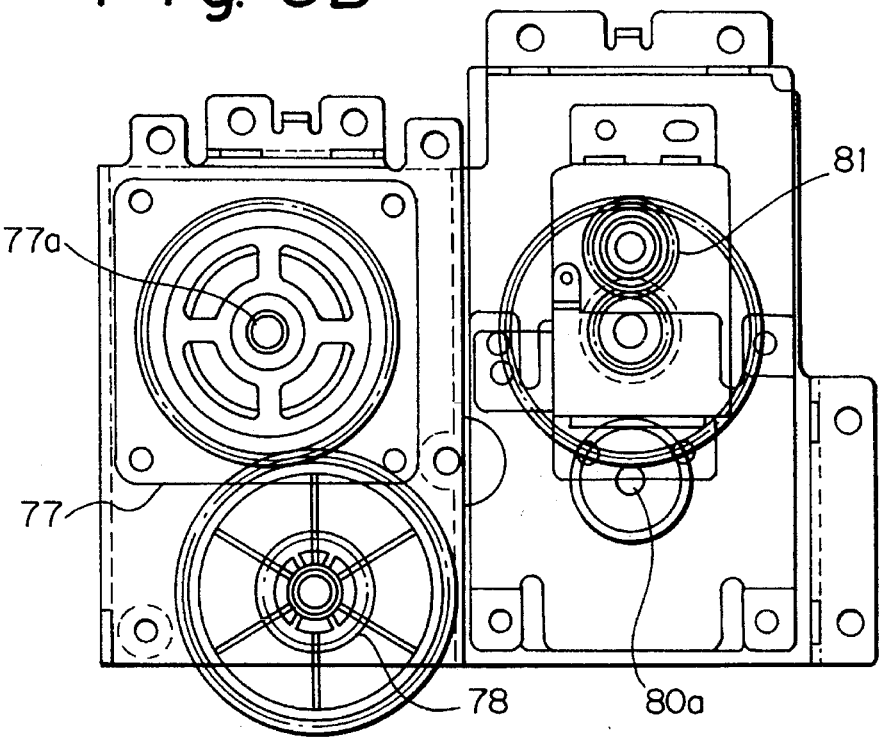
FIG. 8B is a front view of the motor.

FIGS. 8A and 8B are respectively a plan view and a front view showing the drive motor portion of the revolver. As shown, the gears 78 and 81 of the printer body are retractable in the sliding direction of the casing 46, so that the gears of the printer body and those of the revolver can surely mate with each other when the casing 46 is inserted into the printer body. The gears 78 and 81 are constantly biased toward the printer body by springs 102 and 103, respectively. Hence, even when the gears 78 and 81 of printer body and the gears 79 and 95 or the revolver interfere with each other during the insertion of the casing 46, the gears 78 and 81 are retracted to ensure the insertion. Subsequently, the interference is cancelled due to the rotation of the gears 78 and 81. The gears 78 and 81 are pushed out by the springs 102 and 103 to the position closest to the revolver and, therefore, fully meshed with the gears 79 and 95.

FIG. 7A shows a condition wherein the gears stated above are in full mesh with each other. In this condition, the output gear 81 is rotated in a direction A with the result that the gears 99 and 100 are rotated via the input gear 95. The gears 99 and 100 cause the screws 86 and 91 to rotate. Further, the gear 98 is rotated via the input gear 95, gear 100 and idle gear 101 and, in turn, rotates the developing roller 84.

As shown in FIG. 5, the yellow developing unit, for example, has the developing roller 84Y and doctor blade 85Y supported by front and rear small wall pieces 104 which are separable from the other front and rear wall portions. When the chamber should be cleaned or when the parts should be replaced, the small wall pieces 104, carrying the roller 84Y and blade 85Y therewith, can be bodily removed to facilitate the access to the chamber.

Figure 7C:
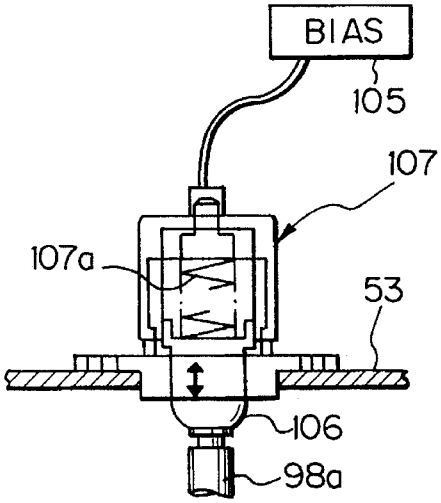
FIG. 7C shows a modification of the revolver.

As shown in FIG. 7C, a bracket 107 is mounted on the printer rear panel 53 at a position facing the developing roller shaft 98*a* when the shaft 98*a* is brought to the developing position. A rod-like terminal 106 is supported by the bracket 107 in such a manner as to be retractable in the sliding direction of the casing 46. A spring 107*a* constantly biases the terminal 106 forward. The terminal 106 has a hemispherical tip. The end of the developing roller 84 is formed with a recess slightly greater in diameter than the hemispherical tip of the terminal 106 and having an arcuate cross-section. When the end of the shaft 98*a* is brought into or out of alignment with the terminal 106 during the rotation of the revolver, the end of the shaft 98*a* and the tip of the terminal 106 are allowed to engage and disengage with a minimum of contact load acting thereon and to remain in contact stably.

Figure 9:
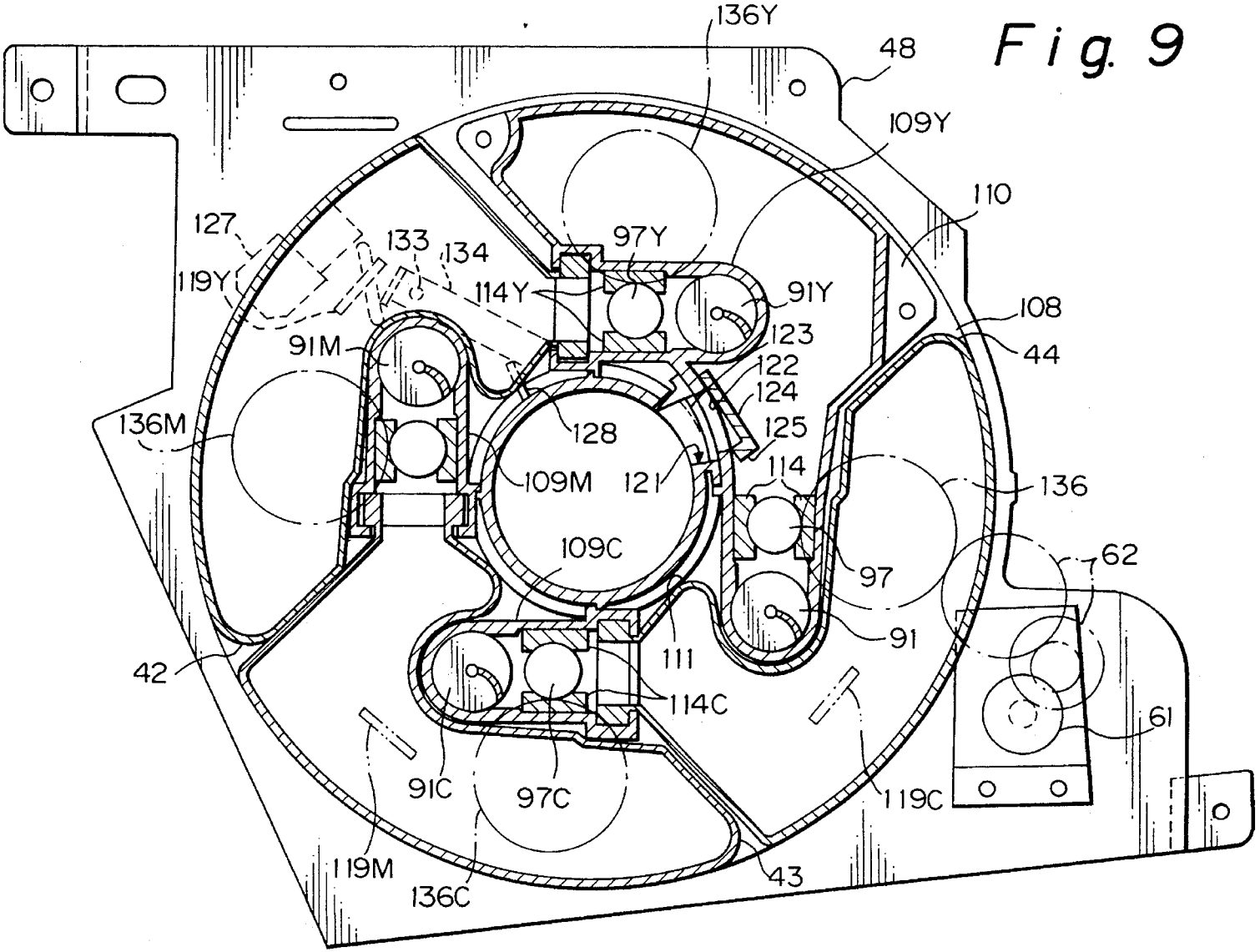
FIG. 9 is a section along line Y—Y of FIG. 3

FIG. 9 is a section along line Y—Y of FIG. 3 and showing the internal arrangement of the toner storing unit 45. The section is also representative of a condition wherein the black developing unit is located at the developing position. As shown, the storing unit 45 has a disk-like base plate 108 (see also FIG. 2). Four receptacles, or cases, 109Y, 109M, 109C and 110 are affixed to the front end of the base plate 108, and each corresponds to one of the chambers of the developing unit 40. Toner supply rollers 97Y, 97M, 97C and 97 are disposed in the receptacles 109Y, 109M, 109C and 110, respectively. The rollers 97Y–97 are journalled to the base plate 108 and the front walls of the associated receptacles 109Y–110 such that they will be each positioned substantially just above the extension of the screw 91 when the corresponding chamber is brought to the developing position.

The base plate 108 is formed with a circular through hole 111 at the center thereof. The hole 111 allows the cylindrical black toner container (see FIGS. 12A and 12B) to be passed therethrough. The receptacles 109Y–110 are so positioned as not to interfere with the holes assigned to the lower screws 91 extending out from the developing chambers, and holes assigned to trough-like screw covers 112 (see FIG. 10) which are optional parts. The screws 91 each extends into one or the receptacles 109Y–110 via the base plate 108.

Figure 10:
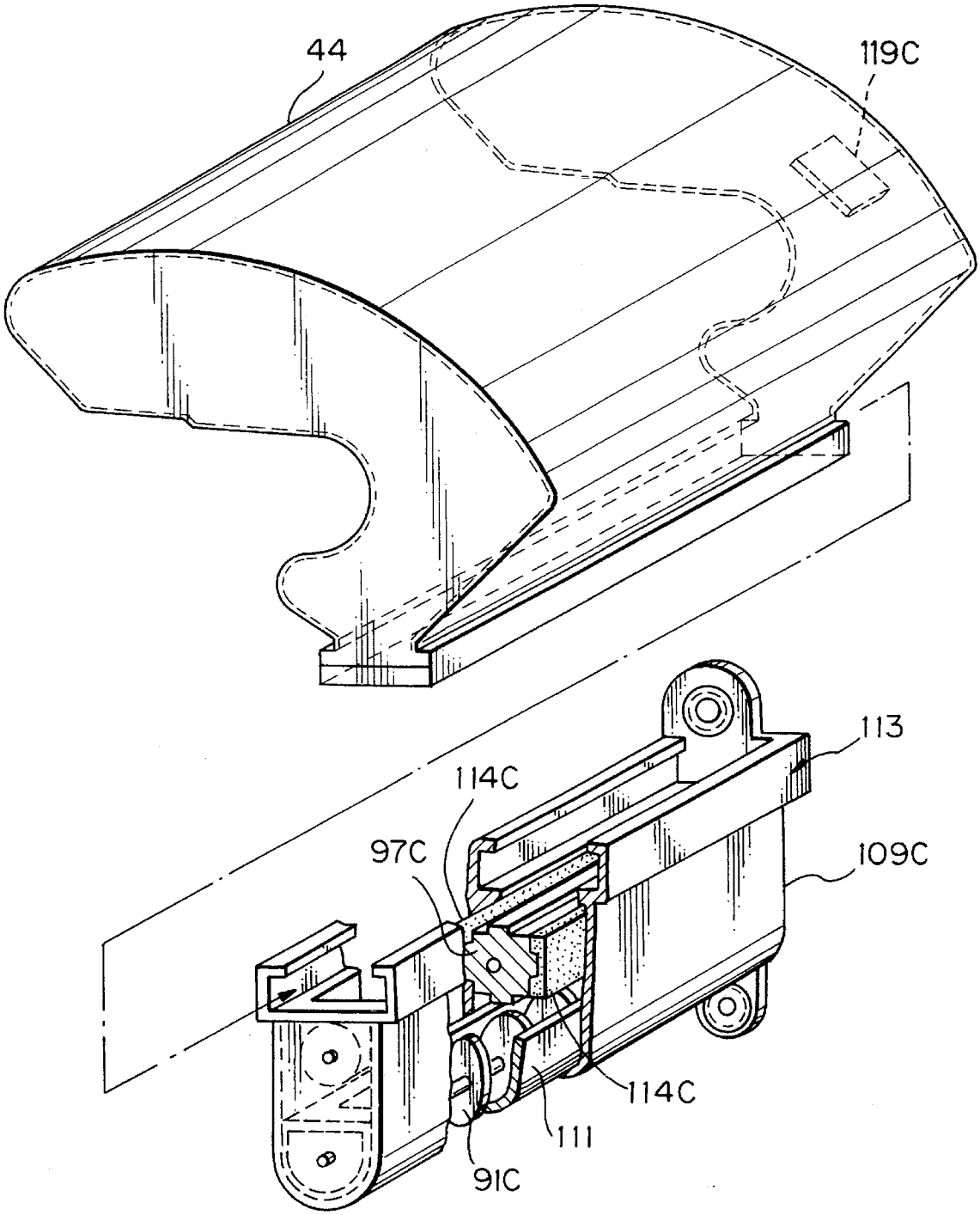
FIG. 10 is a perspective view of a color toner container and a container mount portion included in the revolver.

FIG. 10 shows the receptacle 109C assigned to the cyan loner, and the cyan toner container 44. The receptacles 109Y, 109M and 109C have an identical con figuration. The receptacle 109C, for example, has a wall surrounding the portion of the lower screw 91 present in the receptacle 109C. The wall is formed with a toner inlet at such a position that the inlet overlies the toner supply roller 97C when the assigned chamber is located at the developing position. The inlet is surrounded by a mount portion 113. The cyan toner container 44 is mounted to the mount portion 113 with the outlet thereof facing downward, by being slid in the axial direction of the revolver. Seal members 114C are fitted on part of the inner periphery of the receptacle 109C which lace the roller 97C. The seal members 114C and roller 97C divide the interior of the mouth portion 113 into two portions respectively adjoining the toner container 44 and the chamber. In addition, the seal members 114C and the wall, surrounding the roller 97C and screw 91C, define the previously mentioned communication chamber which is communicated to the associated developing chamber via the hole of the base plate and drop section.

Figure 11A:
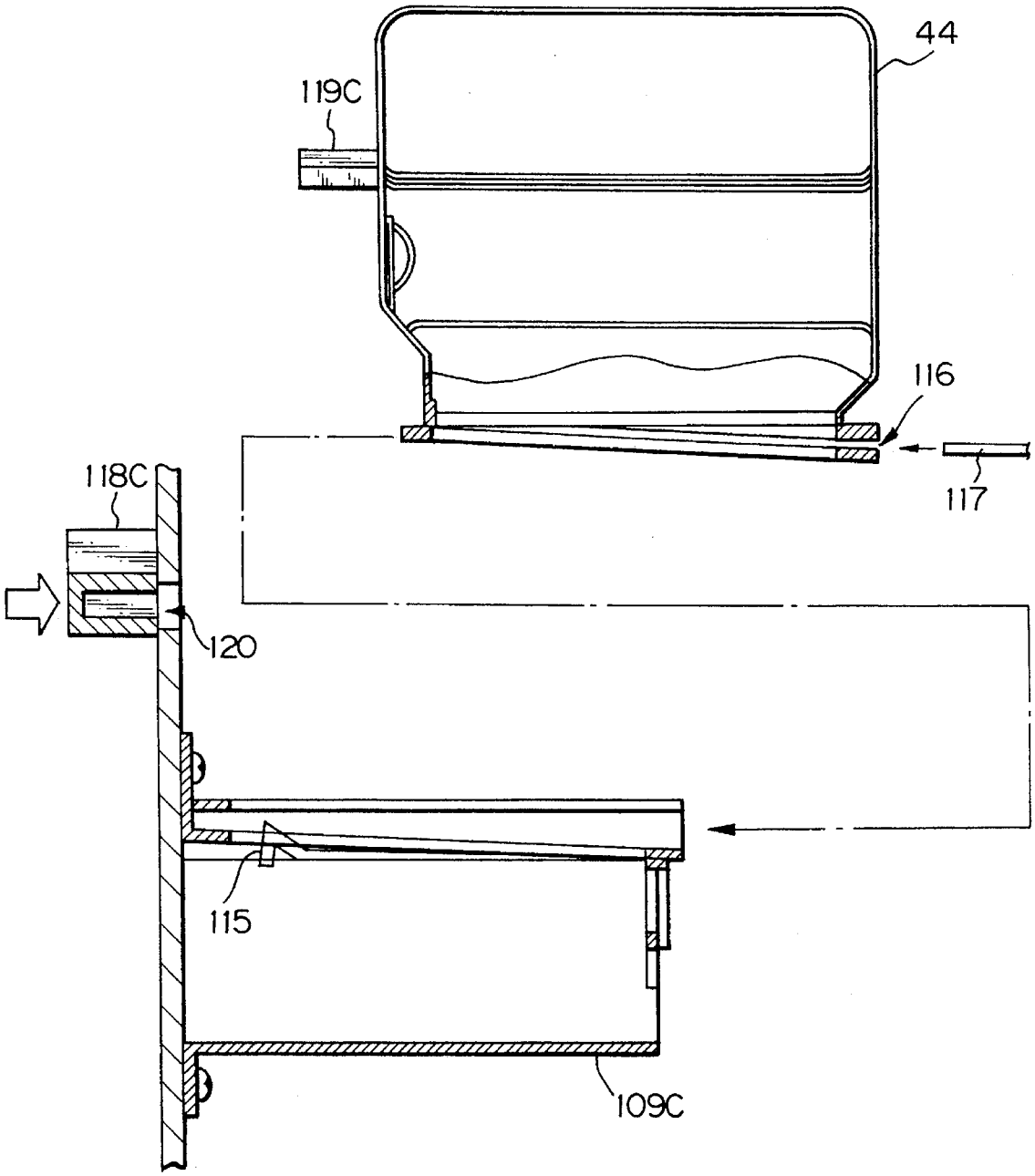
FIG. 11A shows how the container is mounted to the mount portion.

As shown in FIGS. 10 and 11A, the mount portion 113 is configured such that the associated color toiler container can be mounted and dismounted by being slid in the axial direction of the revolver. A safety member 115 (see FIG. 11A) is provided on the mount portion I 13 and protrudes into the toner container via a toiler outlet. The safety member 115 prevents the toner container from being pulled out when it is simply slid in the opposite direction, i.e., toward the operator. A slit 116 is formed in the outlet portion of the toner container. To remove the toner container from the mount portion 113, a shutter member 117 is inserted into the slit 116 to push the safety member 115 out of the toner container. When a new color toner container whose toner outlet is closed by a seal member is to be mounted to the mount portion 113, it is preferable to slide it on the portion 113 and then remove the seal member to uncover the toner outlet.

Figure 11B:
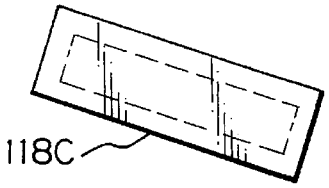
FIG. 11B shows an implementation for sensing the container mounted to the mount portion.

The color toner containers 42, 43 and 44 are each configured to engage with the wall, surrounding the lower screw 91, of one of the receptacles located upstream of the corresponding receptacles with respect to the direction of rotation of the revolver. Lugs 119Y, 119M and 119C are respectively formed on the outer surface of the base plate. A set sensor 118C, shown in FIGS. 11A and 11B by way of example, senses the lugs 119Y–119C. Specifically, set sensors 118Y, 118M and 118C are mounted on the rear of the base plate and implemented by reflection type or transmission type optical sensors. The sensors 118Y–118C are respectively responsive to the ends of the lugs 119Y–119C extending throughout and to the rear of the base plate.

As shown in FIG. 9, the receptacle 110 assigned to the black chamber has a wall substantially identical with the contour of the color toner receptacle 109Y, 109M or 109C and color toner container 42, 43 or 44 mounted thereto. Seal members 114 are fitted on the inner periphery of the portion of the receptacle 110 corresponding to the receptacle. Also, the seal members 114 define a communication chamber communicated to the associated developing chamber in cooperation with the wall surrounding the screw 91. The wall portion similar to the color toner container is formed with a toner inlet 122 in a portion thereof which faces the center line of the revolver. The toner inlet 122 is identical in shape with the toner outlet 121 of the container 41 shown in FIGS. 12A and 12B. Black toner received from the container 41 via the inlet 122 accumulates in the wall portion similar to the color toner container, and a portion surrounded by the roller 97 and adjoining part and corresponding to the hopper of a conventional toner replenishing device. The black toner is conveyed from such portions to the communication chamber by the roller 97. A shutter 124 is rotatably supported at one end by a shaft 123 parallel to the axis of the revolver. The inlet 122 can be closed by the shutter 124 at the inside of the receptacle 110. Specifically, the shutter 124 angularly moves about the shaft 123 due to its own weight while the revolver is in revolution, thereby automatically opening and closing the inlet 122. A seal member 125 is fitted on the edge of the shutter 124.

As shown in FIG. 10, the toner supply rollers 97Y–97 each includes a portion where a plurality of axial grooves are formed in the outer periphery. As shown in FIG. 3, a gear 135 is mounted on the end of a shaft extending throughout the base plate 108 toward the developing unit 40. An input gear 136 is held in mesh with the gear 135. The gears 135 and 136 are assigned to each of the rollers 97Y–97. As shown in FIG. 9, when one developing section or chamber of the developing unit 40 is brought to the developing position, the input gear 136 corresponding to the developing chamber is brought into mesh with the gear 62 which is driven by the motor 61.

Figure 12A:
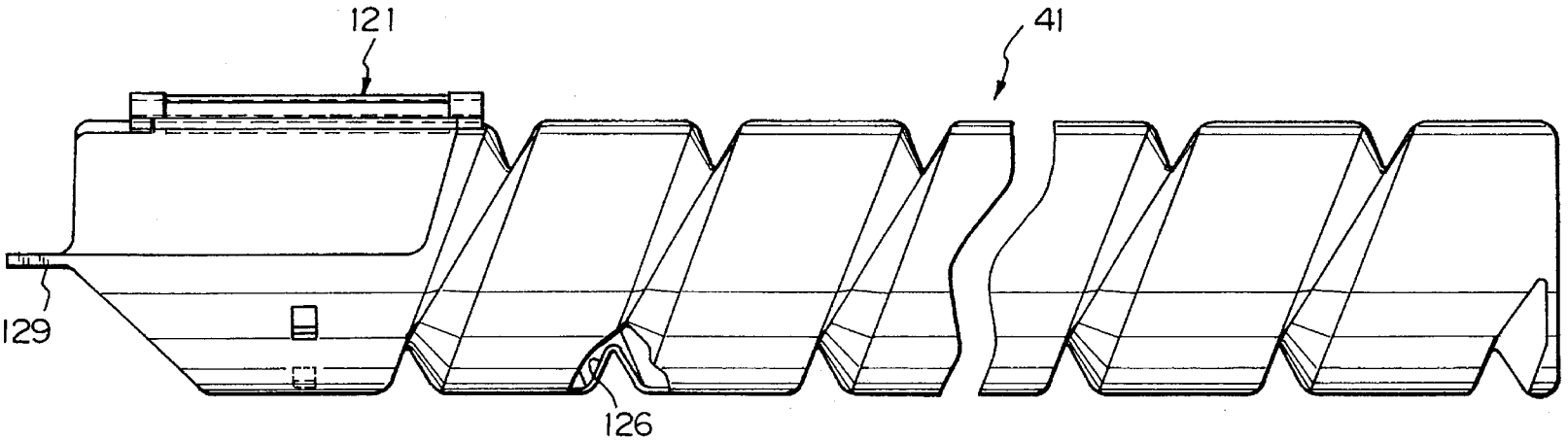
FIG. 12A is a side elevation of a black toner container included in the revolver.
Figure 12B:
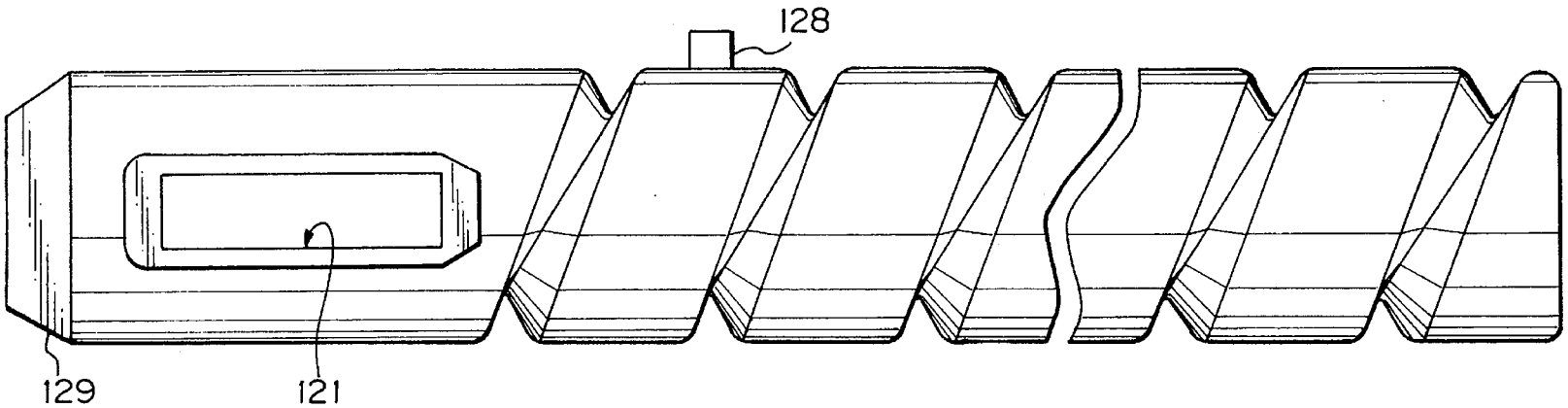
FIG. 12B is a front view of the black toner container.

As shown in FIGS. 12A and 12B, the black toner container 41 has the outlet 121 formed in the circumferential wall of one end portion thereof. A spiral ridge 126 is formed in the inner periphery of the container 41 from the end remote from the outlet 121 toward the outlet 121. When the container 41 is mounted to the revolver, the ridge 126 rotates integrally with the revolver so as to feed the toner from the rear end toward the outlet 121. A lug 128 is provided on the outer periphery of the container 41 at the rear of the outlet 121. A grip portion 129 is provided on the front end of the container 41. A set sensor 127 is mounted on the revolver, i.e., the rear of the front support wall 48 of the casing 46. A link 134 is rotatably mounted on the rear of the support wall 48 by a shaft 133. The lug 128 is sensed by the set sensor 127 via the link 134.

Specifically, the cover 47, FIG. 2, is formed with a notch 130 and a notch 47*a* for the insertion of the container 41. The container 41 is positioned such that the outlet 121 faces upward. After the seal member closing the outlet 121 has been removed, the container 41 is inserted into the revolver through the notch 47*a* with the lug 128 thereof aligned with the notch 130. The container 41 is inserted to the deepest position where the rear end is received in the hollow cylindrical portion 82 of the developing unit 40, and where the front end is substantially flush with the front of the front wails of the cases of the toner storing unit 40, as indicated by a phantom line in FIG. 3. Then, the container 41 is rotated clockwise, as viewed in the figures, about its own axis with the grip portion 129 held by hand, until the outlet 121 aligns with the inlet 122. At this instant, the lug 128 raises the link 134 and causes it to rotate. As a result, the set sensor 127 senses the container 41 via the link 134.

Figure 13:
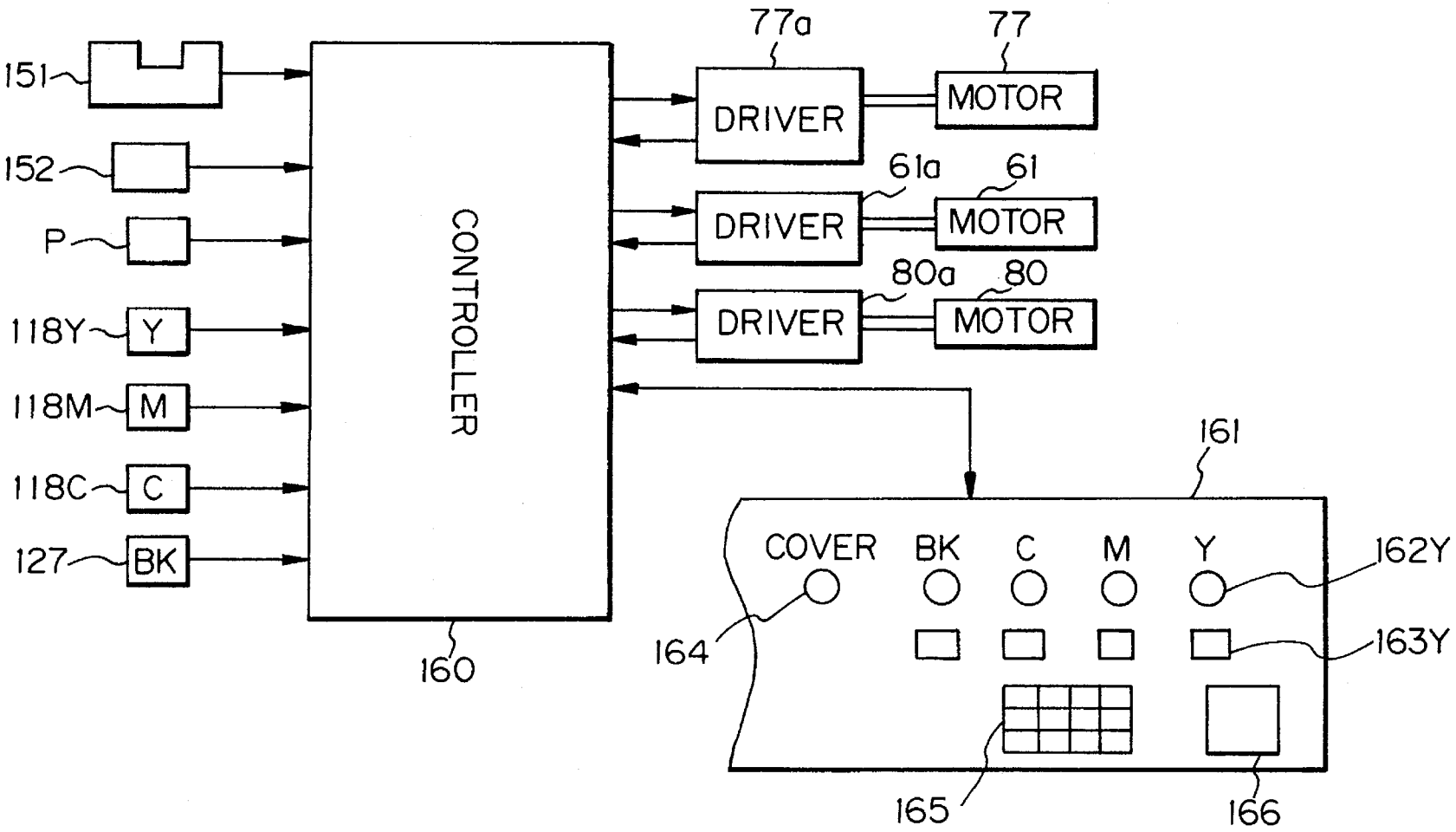
FIG. 13 is a block diagram schematically showing a control system included in the embodiment.

Referring to FIG. 13, a control system included in the printer body is shown. As shown, the system has a controller 160 consisting of a CPU (Central Processing Unit), RAM (Random Access Memory), ROM (Read Only Memory), I/O (Input/Output) interface, tinier and so forth, although not shown in the figure. Connected to the CPU via the I/O interface are a home position sensor 151, a front cover sensor 152, an optical sensor P for toner density control (see FIG. 1), set sensors 118Y, 188M, 118C and 127 responsive to the respective toner containers, motor drivers 77*a*, 61*a* and 80*a* for respectively driving the motors 77, 61 and 80, an operation panel 161, etc. The operation panel 161 has lamps 162Y, 162M, 162C and 162BK for informing the user of the toner near end conditions or the respective developing sections, buttons 163Y, 163M, 163C and 163BK for allowing the user to command the replacement of the toner containers 41, 42, 43 and 44, a lamp 164 for reporting the user the opening of a front cover, numeral keys 165, a print start button 166, etc. As shown in FIG. 3, the home position sensor 151 is mounted on, for example, the front support wall 48 of the casing 46 in order to sense a member 150 provided on the revolver. The output of the sensor 151 is used for the initialization immediately after the power switch of the printer has been turned on and for the movement control following a printing operation. Specifically, the revolver is held at the home position where the sensor 151 senses the member 150, e.g., where the black developing unit is located at the developing position, as shown in FIGS. 5 and 9, after the initialization and during stand-by period after a printing operation.

How the revolver is positioned by the recesses 65, roller 66, and motors 77 and 80 is as follows. In the illustrative embodiment, to replace the developing section located at the developing position, the output gear 79 is rotated in a direction B, FIG. 7A to thereby rotate the revolver in a direction C. Then, the roller 66 falls in one of the recesses 65 which is formed in the outer periphery of the rear end wall 51 of the revolver. Assume that the revolver has failed to rotate a desired angle (e.g. 90 degrees in the event of replacement of the developing section located at the developing position with another section just upstream of the former) due to irregularities in the motor 77 and irregularities in the load of the revolver. Then, the roller 66 fails to mate with the expected recess 65, i.e., to position the revolver. As a result, the distance between the developing roller 84 and the drum 1 differs from the target distance. To obviate this, the illustrative embodiment has the following implementation.

The embodiment controls the rotation of the motor 77 by using a control value matching a slightly greater angle (e.g. by about 3 degrees) than the desired angle in considerations of the irregularities mentioned above, thereby ensuring the rotation of the desired angle. Even when the revolver is rotated more than the desired angle due to such a control value, it can be accurately positioned on the basis of the moment of rotation to act on the revolver at the beginning of rotation of the motor 80. Specifically, as shown in FIG. 7A, the output gear 81 meshing with the input gear 95 of the developing section located at the developing position is rotated in the direction A (as during usual development). As a result, a moment of rotation acts on the revolver in a direction opposite to the direction (outline arrow D) in which the revolver usually rotates, thereby returning the revolver. At the same time, the return of the revolver is stopped as soon as the roller 66 falls in the particular recess 65, so that the revolver is locked in position. For this purpose, the position of the pin 63, supporting the bracket 64, and the position of the pin 63 relative to the revolver are determined such that the bracket 64 counteracts the rotation of the revolver in the returning direction.

In the above construction, to replace the black developing section located at the developing position, as shown in FIGS. 5 and 9, with the cyan developing position by way of example, the revolver must be rotated 90 degrees counterclockwise. In this case, the motor 77 is rotated by the control value capable of surely rotating the revolver more than 90 degrees in consideration of irregularities in, for example the motor 77. Consequently, the revolver is rotated as far as a position where the recess 65 assigned to the cyan developing section slightly passes the roller 66. Then, the motor 80 is energized. The resulting moment of rotation causes the revolver to move in the opposite direction until the roller 66 falls in the above-mentioned recess 65. At this instant, the roller 66 of the bracket 66, which is in a counter position, exerts an intense stopping force on the revolver.

When the revolver is rotated more than the desired angle due to the control value stated above, the roller 66 falls in the recess 65 and then leaves it. At this instant, it is preferable to reduce the load acting on the driveline. For this purpose, as shown in FIG. 7B, each recess 65 may be made up of two portions 65*a* and 65*b;* the portion 65*b* has a smaller inclination than the portion 65*a*. The roller 66 easily leaves the recess 65 via the portion 65*a* during usual revolution. The other portion 65*b* is used to lock the revolver.

Figure 14B:
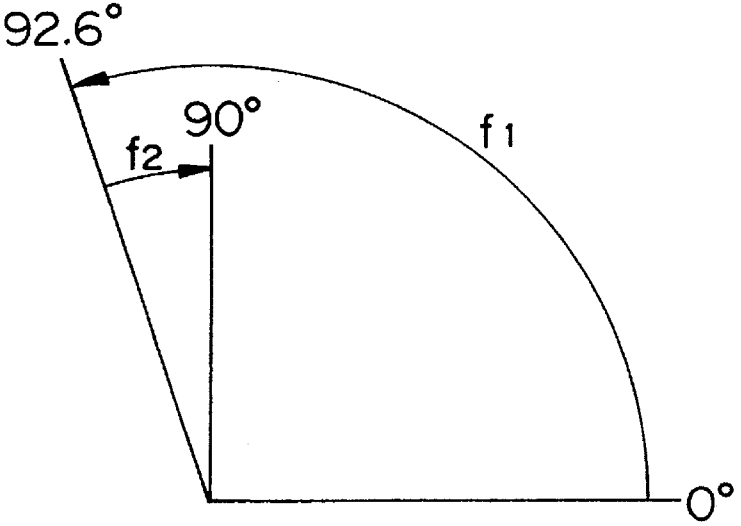
FIGS. 14A and 14B are representative of a specific control scheme for the motor for driving the revolver and available with the embodiment.
Figure 14A:
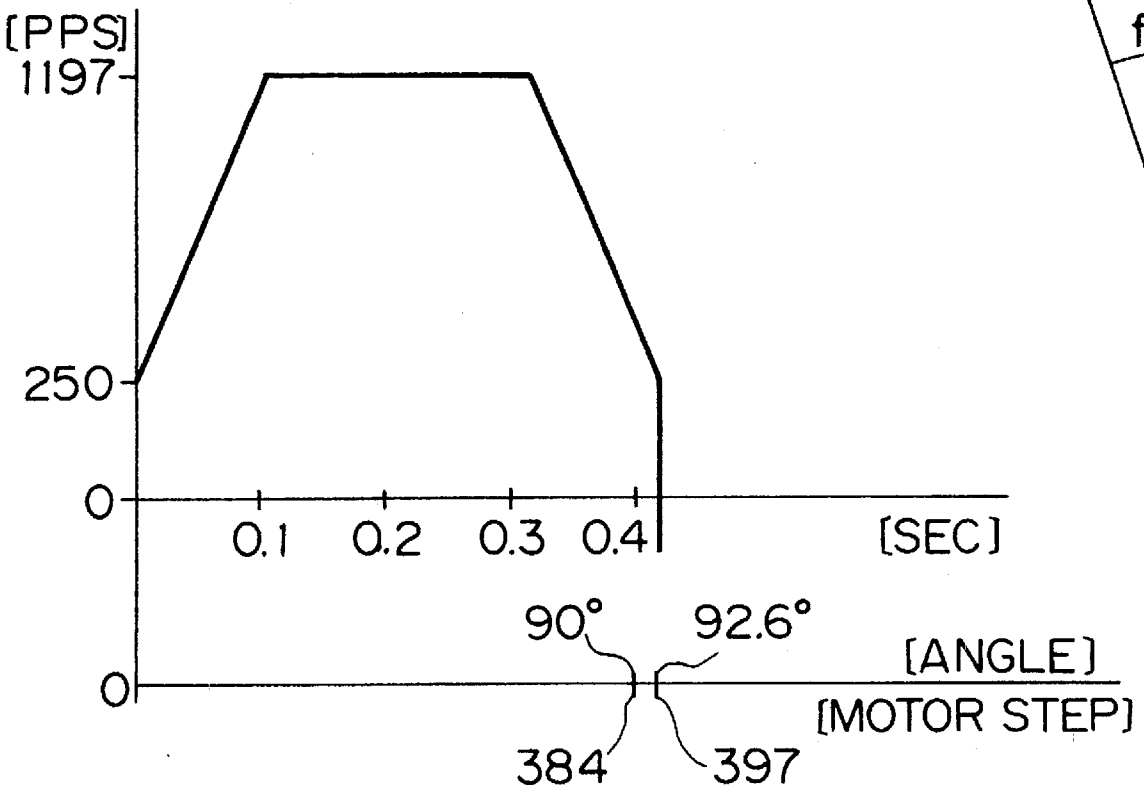

Assume that the motor 77 is implemented by a stepping motor and used to rotate the revolver 90 degrees and then stop it. FIG. 14A shows a change in the number of drive pulses (PPS) for 1 second, and a change in the number of motor steps to occur in the practical control over the stepping motor. FIG. 14B shows a change in the rotation angle of the revolver to occur in the specific control shown in FIG. 14A. As for the rotation of more than 90 degrees, a rotation of 92.6 degrees ($f_1$) is effected by the drive of the stepping motor 77. The stepping motor is of the two-phase drive and has its output shaft rotated 1.8 degrees by one step. The rotation speed of the output shaft is reduced by a reduction ratio of 7.68. Hence, the revolver unit can be rotated 90 degrees by 384 steps. After the motor 77 has been driven by 394 steps to rotate the revolver 92.6 degrees, the motor 80 begins to be driven. The resulting moment of rotation reverses the revolver 2.6 degrees ($f_2$). As a result, the roller 66 falls in the expected recess 65 and thereby positions the revolver.

When the revolver is reversed only by the moment of rotation available with the motor 80, it is likely that the reverse positioning becomes unstable due to the short torque of the motor 80 for the following reason. The drive torque of the motor 80 is selected in consideration of the load to act thereon and determined by the gap between the developing roller 84 and the doctor blade 85, the gap between the roller 84 and the guide 87, the size of the gap between the roller 84 and the separator 87*a* formed integrally with the edge of the guide 87, the amount of developer to pass through each of such gaps, and so forth, as FIG. 5 indicates by taking the black developing section as an example. Because the load to act on the motor 80 is lighter than the torque to act on the motor 77 which is determined by the total weight of the revolver; generally, the former is generally far lighter than the latter. Hence, the moment of rotation for the reversal of the revolver is small. As a result, the full reversal of the revolver is apt to fail, resulting in defective positioning.

Figure 15B:
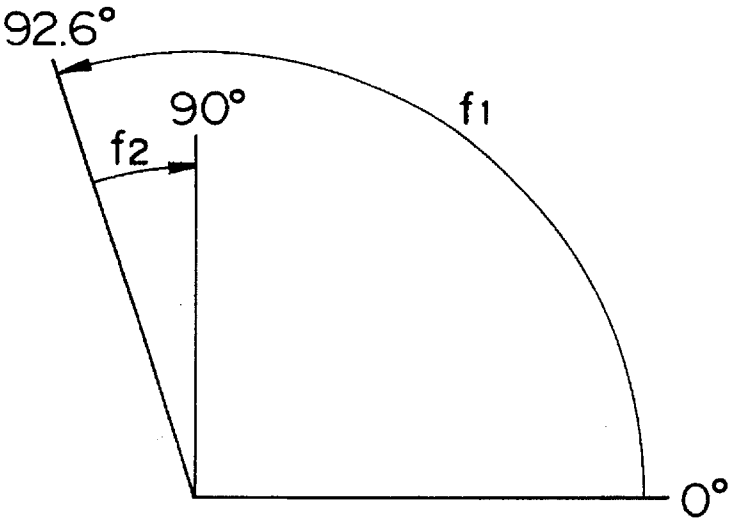
FIGS. 15A and 15B show another specific control scheme for the motor.
Figure 15A:
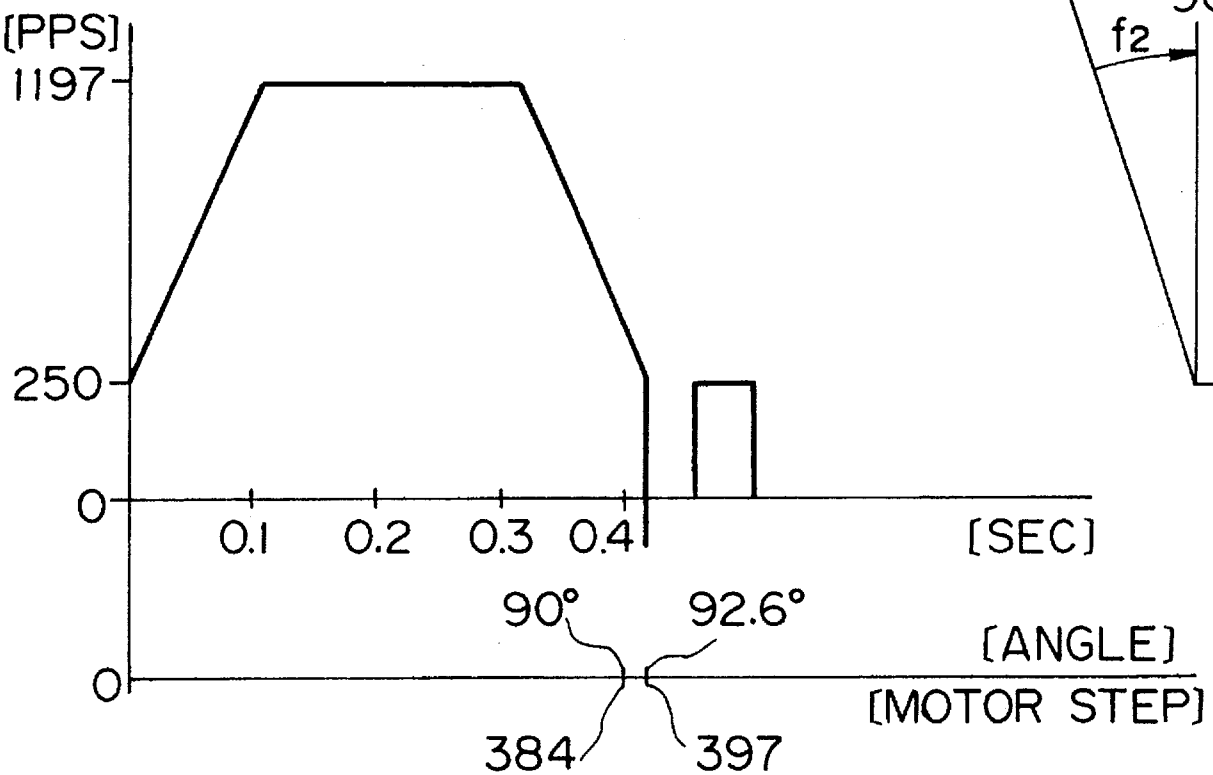

FIGS. 15A and 15B, respectively corresponding to FIGS. 14A and 14B, show an alternative control scheme for obviating the defective positioning attributable to the above occurrence. In this alternative control, even the reversal of the revolver is implemented by the stepping motor 77. As shown, after the motor has been driven by 394 steps to rotate the revolver 92.6 degrees ($f_1$), it is energized for 50 milliseconds to exert a stopping force. Subsequently, the motor is reversed by thirteen steps at a frequency of 250 PPS to return the revolver 2.6 degrees ($f_2$). As a result, the roller 66 falls in the recess 65 and thereby positions the revolver. Because this control scheme effects both the overrun and the return for positioning by use of the motor 77, the revolver can be surely positioned.

Figure 16B:
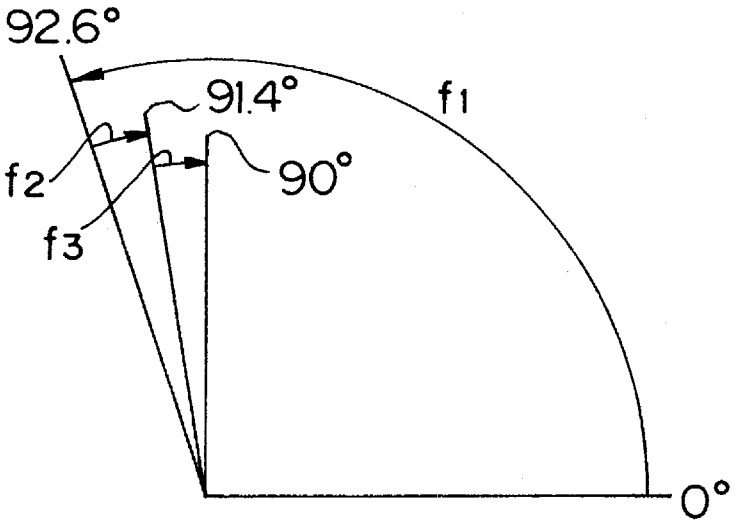
FIGS. 16A and 16B show still another specific control scheme for the motor.
Figure 16A:
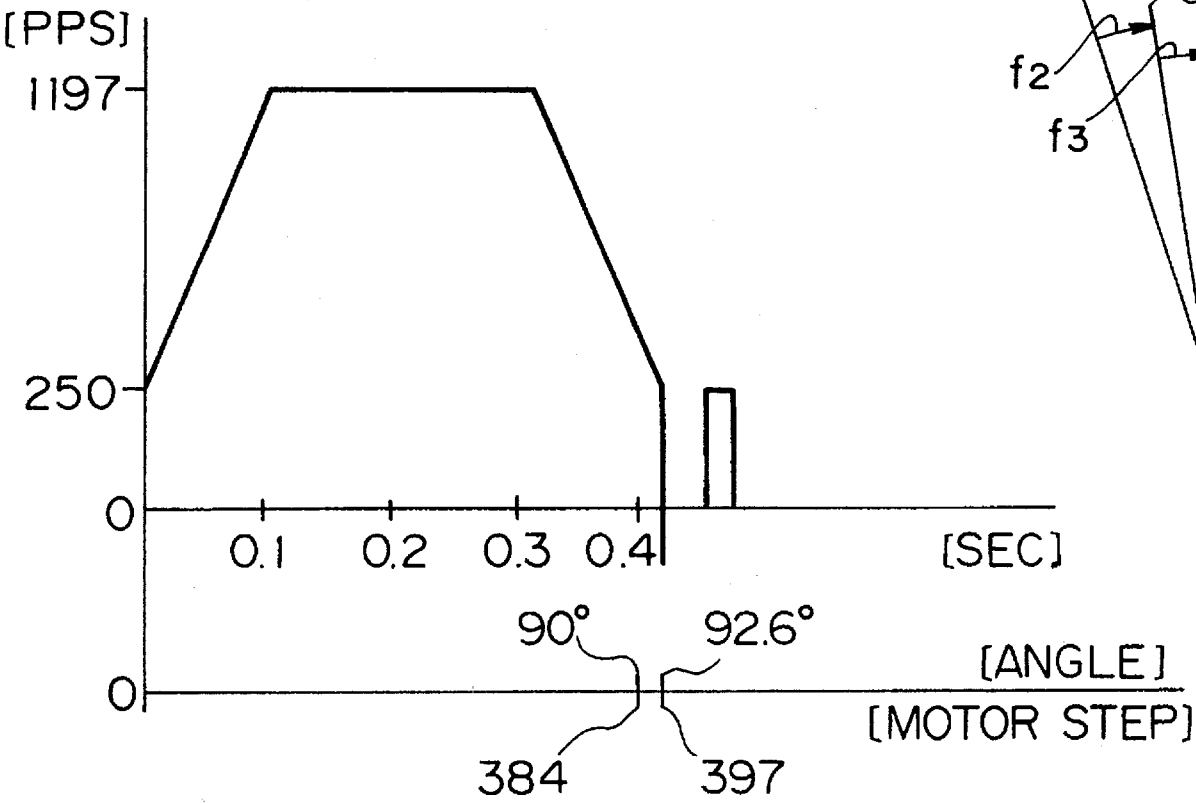

FIGS. 16A and 16B, also corresponding to FIGS. 14A and 14B, show still another control scheme over the rotation of the revolver. This control schemes is intended not only to obviate the defective positioning discussed with reference to FIGS. 14A and 14B, but also to reduce noise apt to occur during the reversal of the revolver. As shown, after the stepping motor 77 has been driven by 394 steps to rotate the revolver 92.6 degrees ($f_1$), it is driven for 50 milliseconds to exert a stopping force. Subsequently, the motor 77 is driven by seven steps in the other direction at a frequency of 250 PPS to return the revolver 1.2 degrees ($f_2$). Then, the motor 80 is energized to implement the remaining 1.4 degrees of reverse rotation ($f_3$). As a result, the roller 66 falls in the recess 65 and thereby positions the revolver.

As stated above, in the control shown in FIGS. 16A and 16B, for the part of the rotation of the revolver in which the roller 66 falls in and rises from the recess 65 and the noise is loudest, the motor 80 is used which generates less noise due to vibration and other causes than the motor 77 which is a stepping motor or similar high-torque motor. Moreover, the initial stage of the reversal following a stop is implemented by the stepping motor 77, so that the inertia of rotary motion acts on the revolver. This successfully eliminates the defective positioning apt to occur when the motor 80 is used alone.

Assume that the stepping motor 77 is used to rotate the revolver in opposite directions for the positioning purpose. Then, to reduce the noise particular to the reversal, pulses lower in frequency than the pulses for the overrun may be applied to the motor 77 in the event of reversal. Further, the motor 77 may be driven by the two-phase drive for the overrun and then driven by the one-two phase for the return, if desired. In addition, the current to be applied to the motor 77 may be selected to be smaller during the return than during the overrun. For example, the current may be 2 amperes for the overrun or 1.2 amperes for the return. Such alternative control schemes are achievable with any of various conventional methods.

In summary, it will be seen that the present invention provides an image forming apparatus capable of accurately positioning a movable body thereof without regard to irregularities in a drive source or changes in load. Further, the apparatus can accurately position the developing sections of a revolver, or movable body, at a developing position where the revolver faces an image carrier. In addition, the apparatus reduces noise attributable to the rotation of the revolver.

Various modifications will become possible for those skilled in the art after receiving the teachings of the present disclosure without departing from the scope thereof.

What is claimed is:

1. An image forming apparatus comprising:

a first movable body movably mounted on a body of said apparatus;

a second movable body movably mounted on said first movable body;

first drive means for driving said first movable body in a first direction;

second drive means for exerting, when a predetermined drive input is applied to said second movable body, a moving force on said first movable body in a second direction opposite to said first direction;

a positioning device for positioning said first movable body in stationary contact therewith against a moving force acting only in said second direction; and control means for controlling said first drive means such that said first movable body moves in said first direction over a target position of said first movable body and for controlling said first and second drive means such that first movable body reverses movement from said first direction to said second direction after passing said target position so that said positioning device is positioned stationary in contact with said first movable body at said target position.

2. An apparatus as claimed in claim 1, wherein said first movable body comprises a rotary developing device having a plurality of developing sections therein;

said second movable body comprising rotary bodies for development and respectively disposed in said plurality of developing sections;

said positioning device comprising a plurality of engaging portions formed in predetermined positions of said developing device and respectively corresponding to said plurality of developing sections, and an engaging member mounted on said body and selectively engageable with said plurality of engaging portions.

3. An apparatus as claimed in claim 1, wherein said second drive means comprises a drive for originally driving said second movable body and which exerts a moving force on said first movable body in said second direction.

4. An image forming apparatus for causing a rotary developing device rotatably mounted on a body of said apparatus and having a plurality of developing sections therein to rotate to thereby move any one of said developing sections to a developing position, said apparatus comprising:

first drive means for rotating said developing device in a predetermined first direction over a target position;

second drive means for rotating said developing device, rotated over said target position by said first drive means, in a second direction opposite to said predetermined first direction to thereby return said developing device toward said target position; and positioning means for causing said developing device upon return arrival at said target position to stop at said target position whenever said developing device is moving in said second direction upon return arrival at said target position.

5. An apparatus as claimed in claim 4, wherein said first drive means and said second drive means comprise a single drive source capable of rotating said developing device in opposite directions.

6. An apparatus as claimed in claim 5, further comprising current switching means for switching a current to said single drive source such that a smaller current is fed for a rotation of said developing device in said second direction than for a rotation in said predetermined first direction.

7. An apparatus as claimed in claim 5, wherein said single drive source comprises a stepping motor.

8. An apparatus as claimed in claim 7, further comprising drive mode switching means for causing said stepping motor to be driven by two-phase drive during a rotation of said developing device in said predetermined first direction and by one-two phase drive during a rotation in said second direction.

9. A method of positioning a rotary developing device as to a rotation angle, and for an image forming apparatus for causing said rotary developing device rotatably mounted on a body of said apparatus and having a plurality of developing sections therein to rotate to thereby move any one of said developing sections to a developing position, said method comprising the steps of:

rotating said developing device in a predetermined first direction over a target position;

switching a driving direction to a second direction opposite said first direction after rotating said developing device over said target position to thereby return said developing device toward said target position; and positioning said developing device at said target position by exerting a stopping force on said developing device whenever said developing device returns to said target position after switching of the driving direction to the second direction.

* * * * *